US006793536B2

(12) United States Patent
Takeyama et al.

(10) Patent No.: US 6,793,536 B2
(45) Date of Patent: Sep. 21, 2004

(54) CONTACT TERMINAL AND CARD CONNECTOR HAVING THE SAME

(75) Inventors: Tetsuo Takeyama, Tokyo (JP); Masaaki Ooya, Yokohama (JP); Minoru Igarashi, Inzai (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 89 days.

(21) Appl. No.: 10/090,800

(22) Filed: Mar. 6, 2002

(65) Prior Publication Data

US 2002/0142663 A1 Oct. 3, 2002

(30) Foreign Application Priority Data

Mar. 7, 2001 (JP) ..... 2001-063996

(51) Int. Cl.[7] ..... H01R 23/70
(52) U.S. Cl. ..... 439/631
(58) Field of Search ..... 439/631, 630, 439/638, 945

(56) References Cited

U.S. PATENT DOCUMENTS

| | | | | |
|---|---|---|---|---|
| 1,477,527 A | | 4/1923 | Raettig | |
| 3,040,291 A | | 5/1962 | Schweitzer | |
| 3,601,774 A | | 8/1971 | Stathos et al. | |
| 3,631,381 A | | 12/1971 | Pittman | |
| 4,220,382 A | * | 9/1980 | Ritchie et al. | 439/61 |
| 4,392,705 A | | 7/1983 | Andrews, Jr. et al. | |
| 4,507,697 A | | 3/1985 | Ozil et al. | |
| 4,734,041 A | | 3/1988 | Bruchmann et al. | |
| 4,850,899 A | * | 7/1989 | Maynard | 439/628 |
| 5,401,185 A | | 3/1995 | Wang et al. | |
| 5,716,221 A | | 2/1998 | Kantner | |
| 5,725,385 A | | 3/1998 | Takano et al. | |
| 5,904,597 A | | 5/1999 | Doi et al. | |
| 5,928,027 A | * | 7/1999 | Kunishi | 439/495 |
| 5,933,328 A | | 8/1999 | Wallace et al. | |

(List continued on next page.)

FOREIGN PATENT DOCUMENTS

| | | |
|---|---|---|
| JP | 47-41714 | 10/1972 |
| JP | 50-56987 | 9/1975 |
| JP | 61-118980 | 6/1986 |
| JP | 04-249082 | 9/1992 |
| JP | 06-036834 | 2/1994 |
| JP | 6-77178 | 10/1994 |
| JP | 8-236187 | 9/1996 |
| JP | 09-027367 | 1/1997 |
| JP | 11111402 | 4/1999 |
| JP | 2000-502490 | 2/2000 |
| JP | 2000251024 | 9/2000 |
| JP | 2000251025 | 9/2000 |
| JP | 2002-117945 | 4/2002 |
| JP | 2002-124343 | 4/2002 |

OTHER PUBLICATIONS

U.S. patent application Ser. No. 09/840,109, Nishimura, filed Apr. 24, 2001.
U.S. patent application Ser. No. 09/842,083, Nishimura, filed Apr. 26, 2001.
U.S. patent application Ser. No. 09/922,866, Ito et al., filed Aug. 7, 2001.
U.S. patent application Ser. No. 09/978,664, Sato, filed Oct. 18, 2001.

(List continued on next page.)

*Primary Examiner*—Tulsidas Patel
*Assistant Examiner*—Phuong Dinh
(74) *Attorney, Agent, or Firm*—Finnegan, Henderson, Farabow, Garrett & Dunner, LLP

(57) ABSTRACT

A contact terminal includes a card connecting section for electrically connecting with a contact pad of the elongate type memory card while being in contact with the contact pad, a cable connecting section for electrically connecting with the electrode pad of the flexible flat cable while pinching the electrode pad, and a fixing section for coupling the card connecting section with the cable connecting section.

11 Claims, 10 Drawing Sheets

U.S. PATENT DOCUMENTS

| | | | | |
|---|---|---|---|---|
| 5,993,261 | A | | 11/1999 | Klatt et al. |
| 6,004,155 | A | | 12/1999 | Wu |
| 6,036,548 | A | | 3/2000 | Braithwaite |
| 6,099,335 | A | | 8/2000 | Chang |
| 6,102,715 | A | | 8/2000 | Centofante |
| 6,162,075 | A | | 12/2000 | Hara et al. ..... 439/159 |
| 6,162,089 | A | | 12/2000 | Costello et al. |
| 6,174,198 | B1 | | 1/2001 | Wu et al. |
| 6,176,737 | B1 | | 1/2001 | Choy |
| 6,183,292 | B1 | | 2/2001 | Chen et al. |
| 6,224,391 | B1 | * | 5/2001 | Horie et al. ..... 439/64 |
| 6,250,965 | B1 | | 6/2001 | Neifer |
| 6,250,966 | B1 | * | 6/2001 | Hashimoto et al. ..... 439/631 |
| 6,261,128 | B1 | | 7/2001 | Heim et al. |
| 6,315,615 | B1 | | 11/2001 | Raistrick |
| 6,328,605 | B1 | | 12/2001 | Walker et al. |
| 6,402,529 | B2 | | 6/2002 | Saito et al. |
| 6,409,546 | B1 | | 6/2002 | Ito et al. |
| 6,508,661 | B1 | * | 1/2003 | Yu ..... 439/495 |
| 6,511,349 | B2 | * | 1/2003 | Ishikawa et al. ..... 439/631 |

OTHER PUBLICATIONS

U.S. patent application Ser. No. 10/046,716, Ooya et al., filed Jan. 17, 2002.

U.S. patent application Ser. No. 10/057,944, Mithuhashi et al., filed Jan. 29, 2002.

U.S. patent application Ser. No. 10/067,891, Ito et al., filed Feb. 8, 2002.

Japanese Office Action and English Translation dated Jan. 21, 2003.

Japanese Office Action dated Jan. 24, 2003 and English Translation.

Official Notice of Rejection of Japanese Patent Application No. 2000–240259, dated Aug. 15, 2003 (in Japanese).

* cited by examiner

CONTACT TERMINAL AND CARD CONNECTOR HAVING THE SAME

This application is based on Japanese Patent Application No. 2001-063996 filed Mar. 7, 2001, the content of which is incorporated hereinto by reference.

BACKGROUND OF THE INVENTION

1. Field of the Invention

The present invention relates to a contact terminal for electrically connecting a connection terminal of a flexible flat cable with an electrode of a card, and to a card connector provided with the same.

2. Description of the Related Art

Various functions have been extended in electronic equipments such as a cellular phone, a telephone, PDA or a camera by mounting, via a card connector, an IC card thereto, such as SIM (subscriber identity module) card, MMC (multi media card) card, SD (secure digital) card, MEMORY STICK (trade mark) or SMART MEDIA (trade mark) in which an integrated circuit for a central processing unit (CPU) or a memory is built-in.

For example, as disclosed in Japanese Patent Application laid-open Nos. 2000-251025 and 2000-251024, a card connector for removably accommodating such an IC card therein is provided with a plurality of contact terminals formed of metallic spring pieces in a connector housing. The card connector electrically connects an integrated circuit within the IC card to an electronic equipment to which is attached the card connector, via the contact of contact points in the plurality of contact terminals with a plurality of contact pads formed on a front or back surface of the loaded IC card within the connector housing.

When connector terminals of a flexible flat cable (FPC) are electrically connected with contact terminals of such a card connector, an FPC connector, for example, as disclosed in Japanese Patent Application laid-open No. 11-111402 (1999) is provided on a wiring board on which the card connector is mounted. In such an FPC connector, a soldering end of the respective terminal thereof is secured by a reflow soldering to a conductive layer formed on the wiring board. While, one end of a contact terminal of a card connector is secured by a reflow soldering to the conductive layer on the wiring board to complete the electrical connection between the both.

However, when the one end of the respective contact terminal of the card connector is fixed to the conductive layer of the wiring board by reflow-soldering, the one end of the contact terminal of the card connector placed on the wiring board is also heated, which may cause the wiring board to be warped or twisted. Thus, the one end of each contact terminal may be separated from the conductive layer of the wiring board to result in the incomplete connection, whereby there is a fear in that part of the contact terminals of the card connector may not be ensured to be electrically connected to the conductive layer of the wiring board.

SUMMARY OF THE INVENTION

In consideration of the above problems, an object of the present invention to provide a contact terminal for electrically connecting electrodes of a card with connection terminals of a flexible flat cable and a card connector having the same, which the contact terminal is capable of ensuring the electric connection of the respective contact terminals of the card connector with the connection terminals of the flat cable without necessitating a wiring board in which a conductive layer is formed.

In accordance with the present invention which attains the above object, there is provided a contact terminal comprising a first connecting section for electrically connecting with a terminal of a cable while pinching the terminal, the first connecting section being formed at one side of the contact terminal, and a second connecting section for electrically connecting with an electrode of a card while being in contact with the electrode, the second connecting section being formed at the other side continuous with the first connecting section.

A coupling section for coupling the first connecting section to the second connecting section may be provided between the first and second connecting sections.

The coupling section may have coupling surfaces orthogonal to each other and coupled to the first and second connecting sections, respectively.

A card connector having contact terminals according to the present invention comprises contact terminals, each having a first connecting section for electrically connecting with a terminal of a cable while pinching the terminal, the first connecting section being formed at one side of the contact terminal and a second connecting section for electrically connecting with an electrode of a card while being in contact with the electrode, the second connecting section being formed at the other side continuous with the first connecting section, a card accommodation portion in which the second connecting sections of the contact terminals are disposed, for accommodating the card having said electrodes for the electric connection with the second connecting sections, and a cable connecting section in which the first connecting sections of the contact terminals are disposed, having an insertion slot for allowing the terminals of a cable to be inserted for the electric connection with the first connecting sections.

In the contact terminal, a coupling section for coupling the first connecting section to the second connecting section may be provided between the first and second connecting sections.

Further, the coupling section of the contact terminal is held while being inserted into a groove formed over the card accommodation portion and the cable connecting section.

The coupling section of the contact terminal may be inserted into the groove in the inserting direction of the card into the card accommodation portion.

The card may be removably accommodated in the card accommodation portion.

A plurality of contact terminals may be provided in correspondence to a plurality of electrodes in the card accommodated in the card accommodation portion.

The card may be an elongate type memory card.

As apparent from the above description, according to a contact terminal and a card connector having the same, since a first connecting section for electrically connecting with a terminal of a cable while pinching the terminal, the first connecting section being formed at one side of the contact terminal, and a second connecting section for electrically connecting with an electrode of a card while being in contact with the electrode, the second connecting section being formed at the other side continuous with the first connecting section are provided, it is possible to ensure the electric connection of the respective contact terminal with a connecting terminal of a flat cable without the necessity of a wiring board having a conductive layer.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 3:
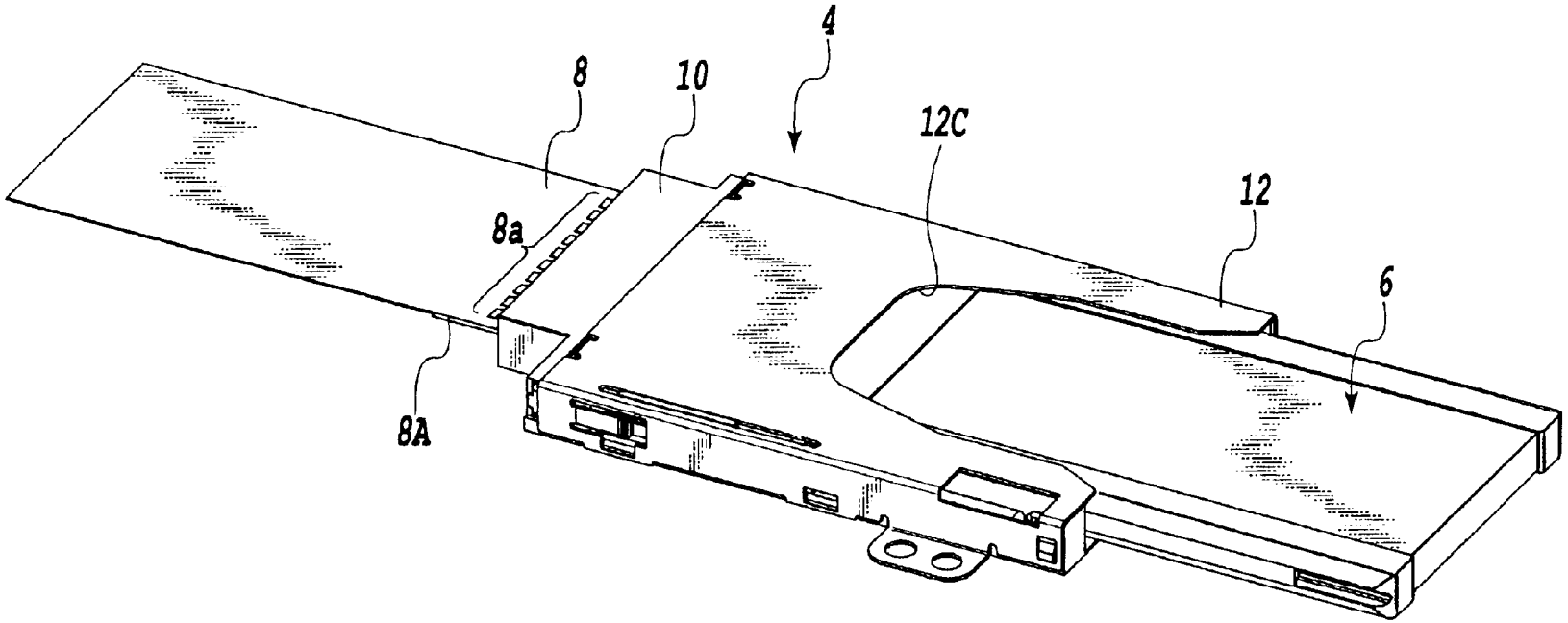
FIG. 3 is a perspective view showing one embodiment of a card connector provided with the contact terminals according to the present invention, together with an elongate type memory card and a flat cable to be applied therewith.

FIG. 3 illustrates one embodiment of a card connector provided with contact terminals according to the present invention, together with a flexible cable to be connected and a card to be accommodated.

In FIG. 3, the card connector 4 is used for electrically connecting an electrode section of an elongate type memory card 6 to be removably accommodated in a storage room thereof with a connection terminal section of a flexible flat cable (FPC) 8. The card connector 4 is disposed, for example, in the interior of an electronic equipment such as a cellular phone, a telephone, PDA or a camera.

Figure 4A:
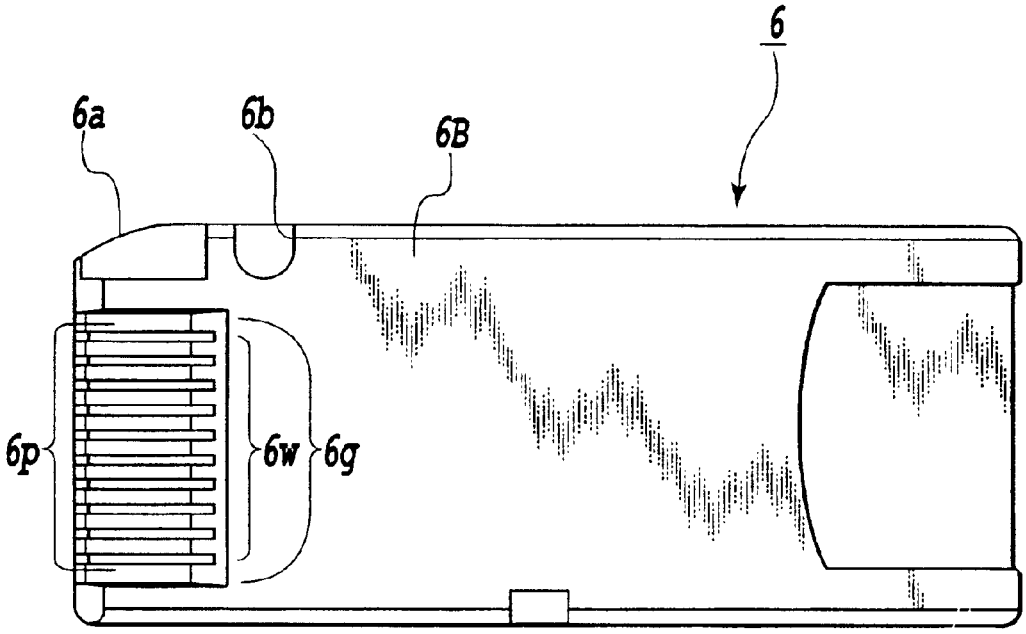
FIG. 4A is a plan view showing an elongate type memory card to be applied with the embodiment of the card connector provided with the contact terminals according to the present invention.
Figure 4B:
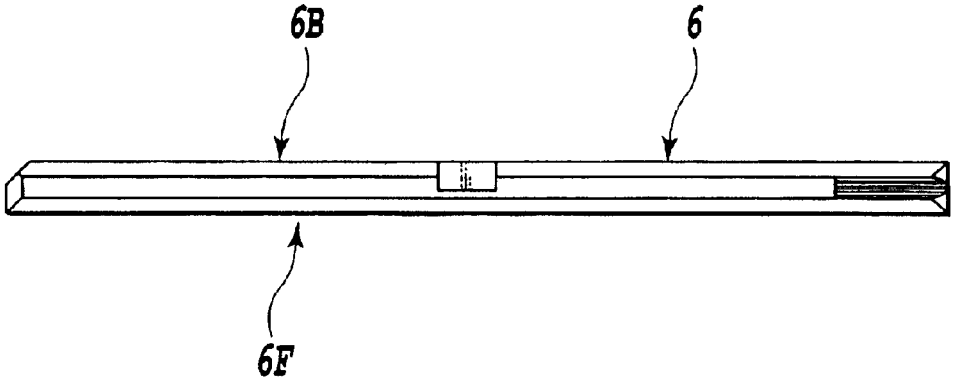
FIG. 4B is a side view of the memory card shown in FIG. 4A.

The elongate type memory card 6 is a kind of a memory card such as MEMORY STICK (trademark). As shown in FIGS. 4A and 4B, the plate-like elongate type memory card 6 has a chamfered portion 6*a* at one corner of a tip end thereof for preventing the erroneous insertion of the card. A relatively shallow recess 6*b* is formed on a back surface 6B adjacent to the chamfered portion 6*a*, to be engaged with an eject rod described later.

The elongate type memory card 6 has a front surface 6F opposite to the back surface 6B. In a tip end region of the back surface 6B, there are plurality of recesses 6*g* extending generally parallel relative to a longer side of the card in a side-by-side manner. The adjacent recesses 6*g* are sectioned with a partition wall 6*w*. On the bottom surface of the respective recess 6*g*, a contact pad 6*p* is disposed. The contact pad 6*p* is, for example, of a ten-pin type.

As shown in FIG. 3, the flexible flat cable 8 has a plurality of electrode pads 8*a* in one end region on the front surface to be connected. The plurality of electrode pads 8*a* used as connection terminals are formed in one row along a shorter side to be parallel to each other at a predetermined pitch corresponding to the arrangement of contact terminals 2 described later. On the other hand, in the end region of the back surface, a backup plate 8A is provided.

Figure 5:
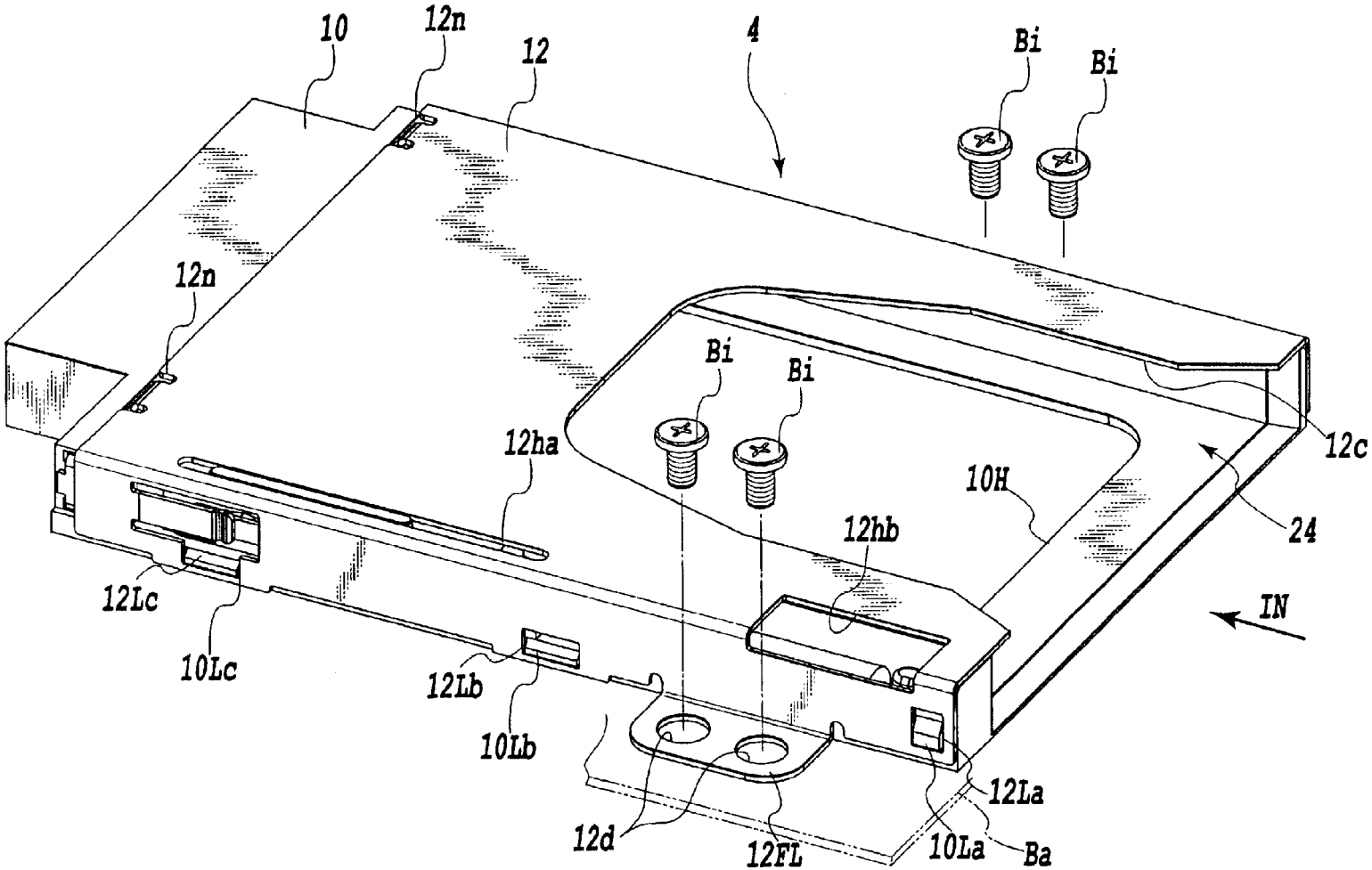
FIG. 5 is a perspective view illustrating an appearance of the embodiment of the card connector provided with the contact terminals according to the present invention.
Figure 9:
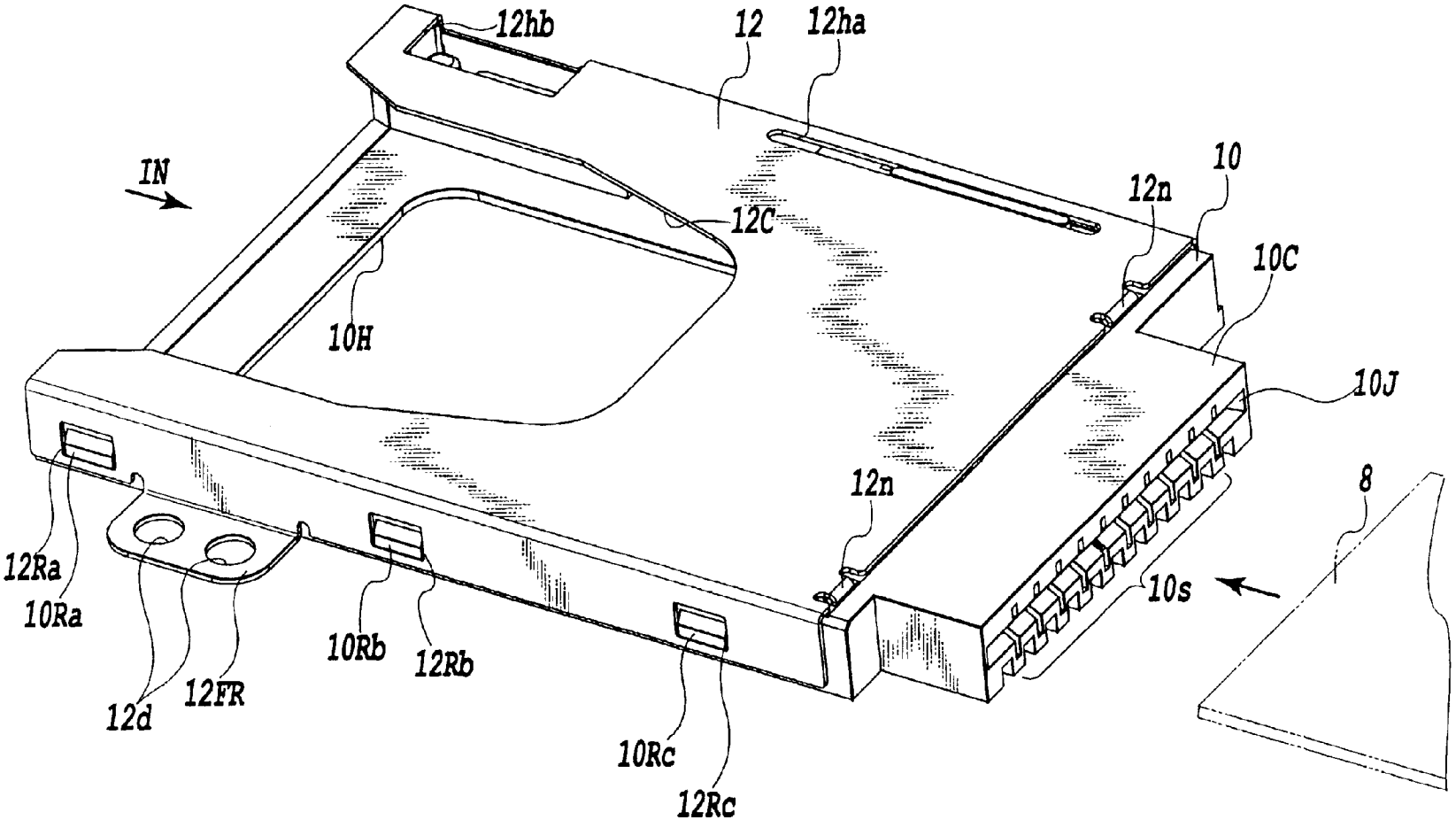
FIG. 9 is a perspective view illustrating an appearance of an embodiment of the card connector provided with the contact terminals according to the present invention.

As shown in FIGS. 5 and 9, the card connector 4 includes a housing member 10 for removably accommodating the elongate type memory card 6 and a cover member 12 covering the housing member 10.

The cover member 12 having a rectangular cross-section is made of a metallic material of a metal sheet. In a generally middle portion of a flat surface of the cover member 12, an opening 12C for facilitating the insertion/removal of the elongate type memory card 6 is formed. Also, on the left side surface of the cover member 12 as seen in the inserting direction of the elongate type memory card 6 shown by an arrow IN in FIG. 5, engagement holes 12La, 12Lb and 12Lc to be engaged with nibs 10La, 10Lb and 10Lc of the housing member 10 described later are formed. Between the engagement holes 12La and 12Lb, an attachment flange 12FL to be attached to a base Ba is formed integral with the cover member. Through-holes 12*d* are provided in the flange 12FL for the insertion of screws Bi in two places.

On the left side of the flat surface of the cover member 12, an elongate hole 12*ha* is formed for the engagement with an upper portion of an ejector member of an ejection mechanism described later. Adjacent to the elongate hole 12*ha*, an opening 12*hb* is formed.

On the right side surface of the cover member 12 as seen in the inserting direction of the elongate type memory card 6 shown by an arrow IN in FIG. 9, engagement holes 12Ra, 12Rb and 12Rc to be engaged with nibs 10Ra, 10Rb and 10Rc of the housing member 10 described later are formed. Between the engagement holes 12Ra and 12Rb, an attachment flange 12FR to be attached to the base Ba is formed integral with the cover member. Through-holes 12*d* are provided in the flange 12FR for the insertion of screws Bi in two places.

Further, on a cable-connection side of the housing member 10, the flat surface of the cover member 12 has a pair of lips 12*n* formed therein spaced at a predetermined distance. These lips 12*n* are engaged with a pair of recesses log provided in two places in the housing member 10 shown in FIG. 10, respectively.

Thus, the cover member 12 is secured to the housing member 10 by the engagement of the engagement holes 12La to 12Lc and 12Ra to 12Rc and the lips 12*n* of the cover member 12 with the nibs 10La to 10Lc and 10Ra to 10Rc and the recesses 10*g* of the housing member 10, respectively.

Figure 6:
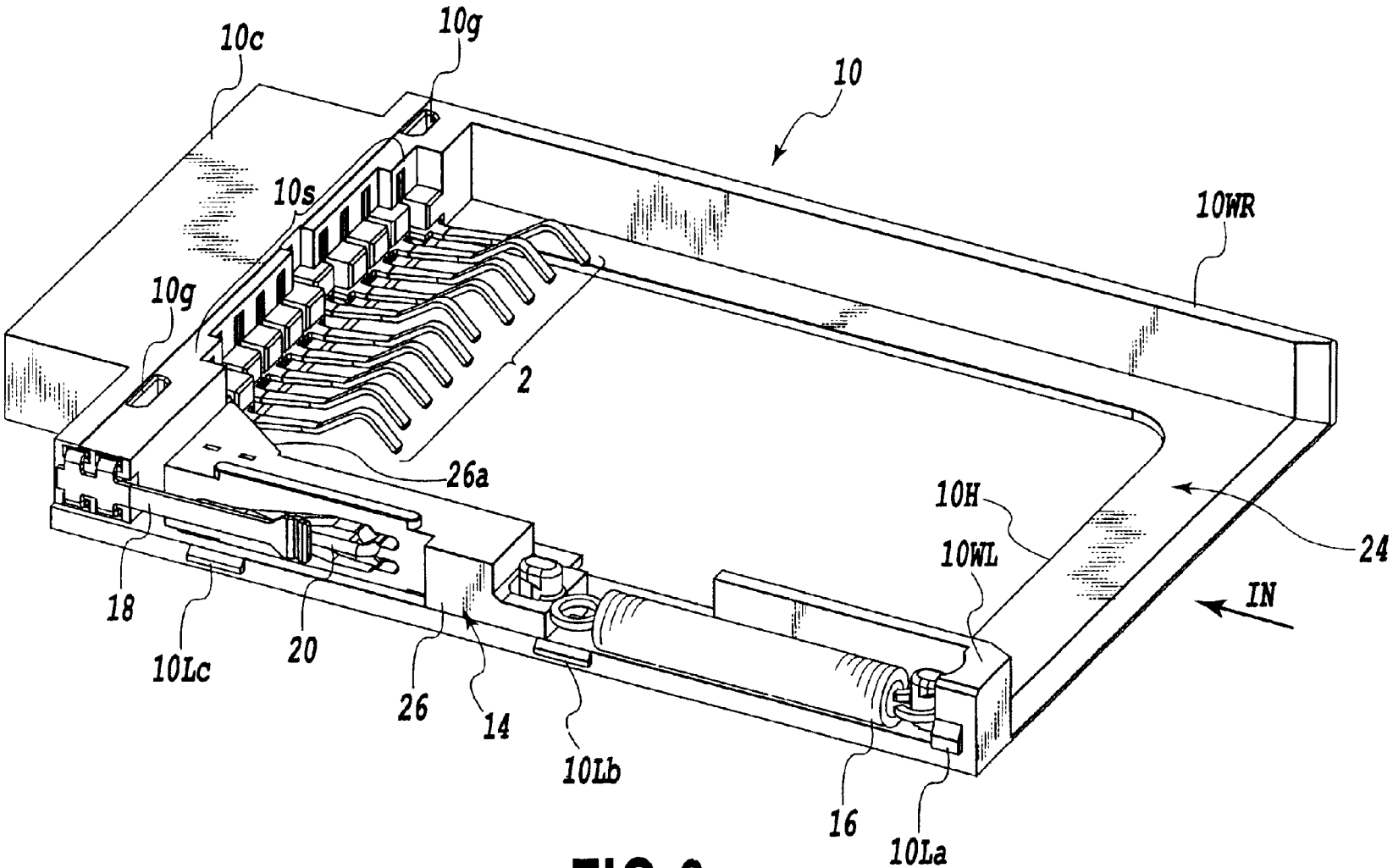
FIG. 6 is a perspective view showing a housing member for the card connector provided with the contact terminals according to the present invention.

An accommodation portion 24 in the housing member 10 opens upward and to an end opposite to a cable connecting section 10C as shown in FIG. 6. Thus, when the housing member 10 is covered with the cover member 12, a slot is defined at one end of the accommodation portion 24 for inserting the elongate type memory card 6.

The housing member 10 is molded with a molding resin material in one piece, for example. As shown in FIG. 6, the housing member 10 includes a pair of lateral walls 10WR and 10WL for defining opposite sides of the accommodation portion 24 respectively in which is removably accommodated the elongate type memory card 6, and the cable connecting section 10C to be connected to the connection terminals of the flexible flat cable 8.

Figure 10:
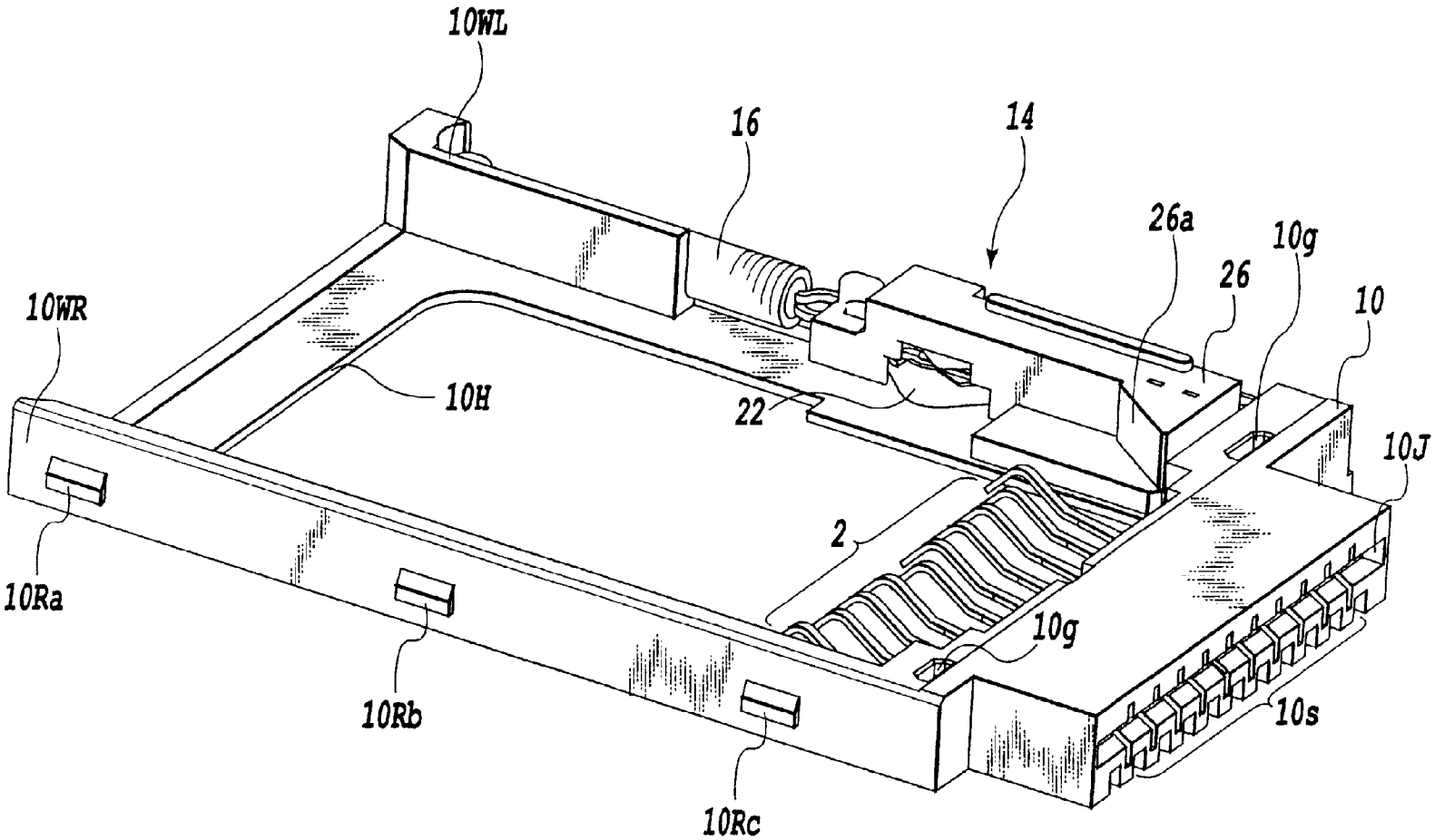
FIG. 10 is a perspective view illustrating the housing member for an embodiment of the card connector provided with the contact terminals according to the present invention.

As shown in FIG. 10, nibs 10Ra, 10Rb and 10Rc are provided at a predetermined spacing in the lateral wall 10WR.

As shown in FIG. 6, an ejection mechanism 14 is provided on the outer side of the lateral wall CL for optionally ejecting the elongate type memory card 6 out of the accommodation portion 24 in the elongate type memory card 6.

The ejection mechanism 14 is one operable in such a manner as proposed, for example, in Japanese Patent Application laid-open Nos. 2000-251025 and 2000-251024 filed by the applicant of this application.

The ejection mechanism 14 includes a generally L-shaped ejector member 26 movable relative to the housing 10 along a guide groove (not shown) formed in the housing member 10, a nickel-plated coil spring 16 interposed between the housing member 10 and the ejector member 26, and a cam mechanism 20 for selectively locking or unlocking the ejector member 26 relatively to the housing 10.

For example, at a front end of the ejector member 26 molded with a resinous material, a slanted portion 26*a* enagageable with the chamferred portion 6*a* of the inserted elongate type memory card 6 is formed as shown in FIGS. 6 and 10.

The cam mechanism 20 includes a generally heart-shaped cam element (a heart cam) formed in a forward lateral wall of the ejector member 26, a plurality of lever-guiding grooves formed around the heart cam, a stapler's needle-shaped cam lever held at one end by the housing member 10 and slidable at the other end along the lever-guiding grooves, and a cam pressing member 18 for biasing a front end of the cam lever toward a guide surface of the plurality of lever-guiding grooves.

As shown in FIG. 10, the ejector member 26 is provided with a thin plate-like ejector rod 22 for preventing the inserted elongate type memory card 6 from being suddenly ejected out of the accommodation portion 24. The ejector rod 22 is adapted to restrict the movement of the elongate type memory card 6 by the engagement of the front end thereof with the recess 6*b* of the elongate type memory card 6.

According to such an arrangement, when elongate type memory card 6 is inserted into the accommodation portion 24 to press the ejector member 26 against the bias of the coil spring 16, the cam mechanism 20 locks the ejector member 26. Thereby, the elongate type memory card 6 is maintained in the accommodation portion 24 while bringing the contact pads 6*p* of the elongate type memory card 6 into contact with the contact terminals 2 described later.

On the other hand, when one wishes to remove the elongate type memory card 6 from the accommodation portion 24, the accommodated elongate type memory card 6 is somewhat pushed further into the space. Thereby, the ejector member 26 is unlocked by the action of the cam mechanism 20. Accordingly, the ejector 26 moves forward from the accommodation portion 24 by the recovery force of the coil spring 16 to eject out the elongate type memory card 6.

In the bottom wall contiguous to the lateral walls 10WR and 10CL, an opening 10H is formed in a generally central region thereof.

There are plurality of contact terminals 2 in the wall section of the housing member 10 on the periphery of the accommodation portion 24 in the vicinity of the cable connecting section 10C. For example, ten contact terminals 2 are arranged at a predetermined pitch generally parallel to the lateral walls 10WR and 10CL.

Figure 1:
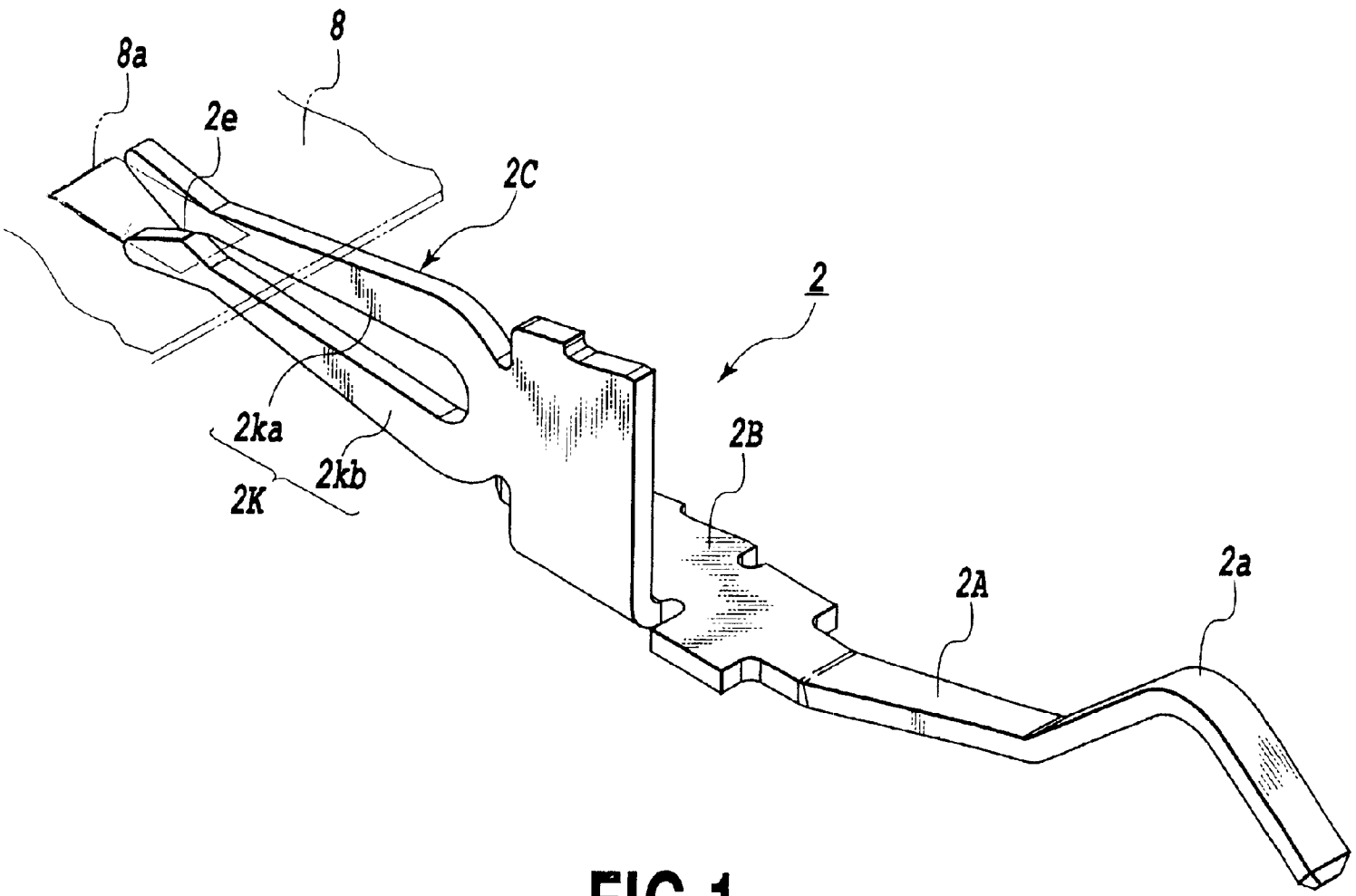
FIG. 1 is a perspective view showing one embodiment of a contact terminal according to the present invention.
Figure 2:
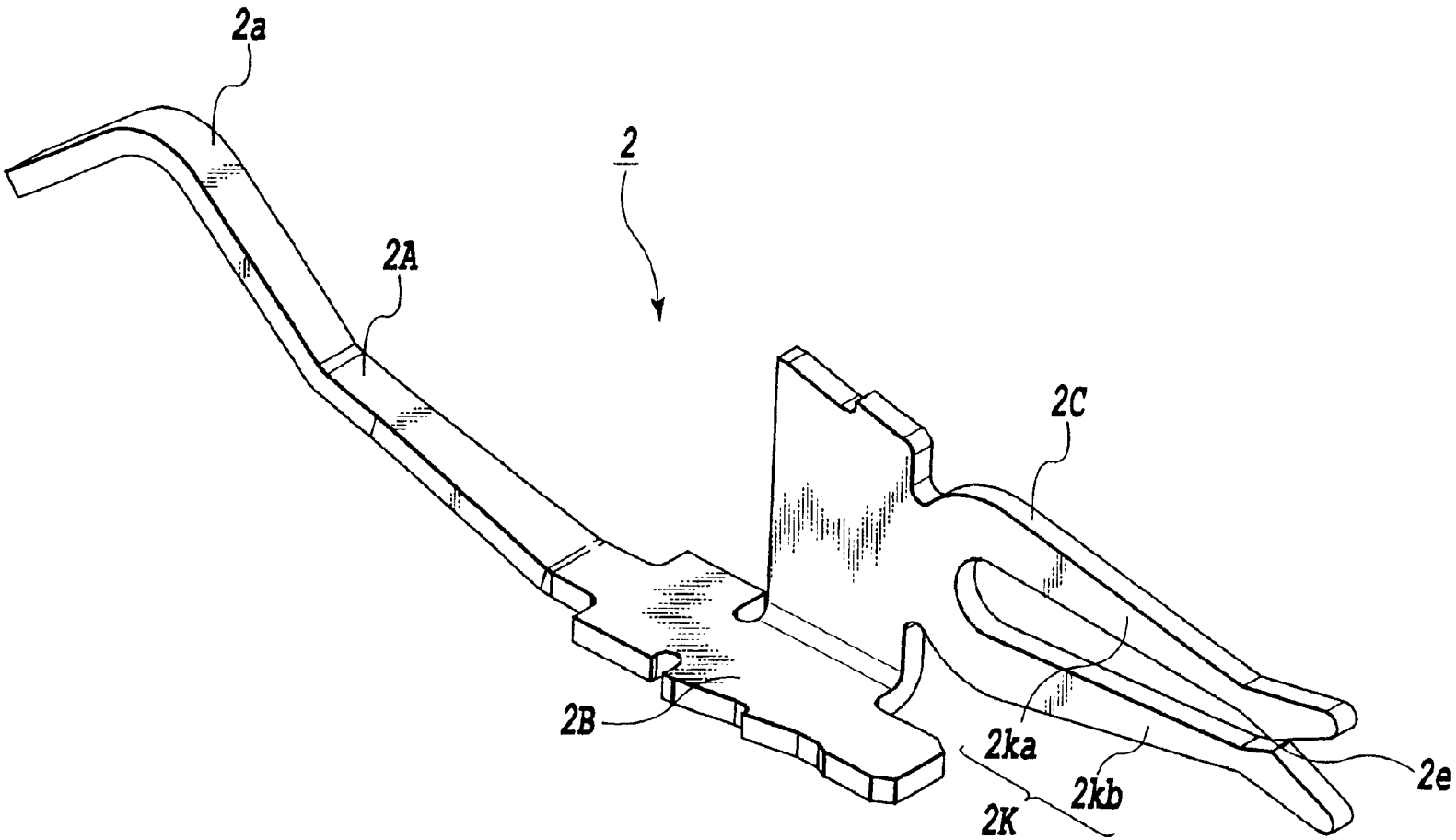
FIG. 2 is a perspective view showing the contact terminal shown in FIG. 1 as seen in the different direction.

As shown in FIGS. 1 and 2, the contact terminal 2 includes a card connecting section 2A to be brought into contact with the contact pad 6*p* of the elongate type memory card 6 and electrically connected therewith, a cable connecting section 2C for pinching the electrode pad 8*a* of the flexible flat cable 8 and electrically connecting the same, and a fixing section 2B to be secured to the housing member 10, for coupling the card connecting section 2A with the cable connecting section 2C. In this regard, in FIGS. 1 and 2, one contact terminal 2 is illustrated in an enlarged scale.

The contact terminal 2 is formed by a press working, for example, using made of a metallic material of metal sheet such as spring-phosphor bronze, and then is given gold plating on the surface thereof.

At one end of the card connecting section 2A, a curved portion in an inverse-V shape is formed. A contact point 2*a* to be in contact with the contact pad 6*p* is defined at a top of the curved portion. The other end of the card connecting section 2A is formed contiguous to one of flat portions of the fixing section 2B.

The cable connecting section 2C has a clip portion 2K consisting of bifurcate forks 2*ka* and 2*kb* for pinching the electrode pad 8*a* of the flexible flat cable 8 in association with each other. The clip portion 2K is formed to be flush with the other of two plane intersecting at right angles each other in the fixing section 2B described before. Thus, the clip portion 2K is formed in a plane generally orthogonal to a plane containing a proximal end of the card connecting section 2A.

At a front end of the fork 2*ka*, a contact point 2*e* to be in contact with the electrode pad 8*a* of the flexible flat cable 8 is formed. The bifurcate forks 2*ka* and 2*kb* are adapted to be away from each other as shown by a chain double-dashed line in FIG. 1 when the electrode pad 8*a* of the flexible flat cable 8 is inserted between both the forks, and then brought into contact with the electrode pad 8*a* by the contact points 2*e* thereof at a predetermined pressure. On the other hand, when the electrode pad 8*a* is withdrawn from a gap between the pair of forks, the forks are close to each other due to the elasticity thereof.

Accordingly, one of more than one flat surface in the fixing section 2B having an L-shaped cross-section is coupled to the proximal end of the card connecting section 2A, and the other of the flat surfaces is coupled to the clip portion 2K.

Figure 7A:
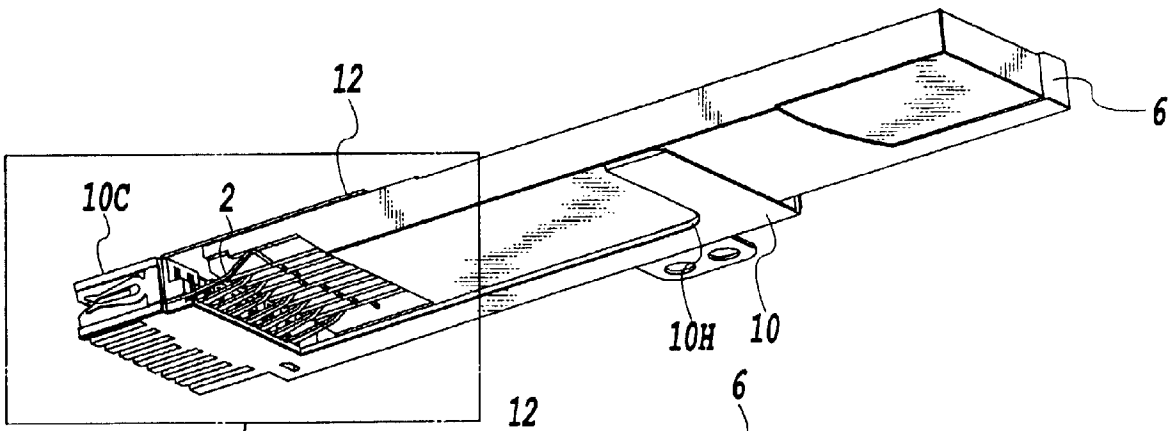
FIG. 7A is a perspective view showing the housing member for the card connector provided with the contact terminals according to the present invention, together with the elongate type memory card.
Figure 7B:
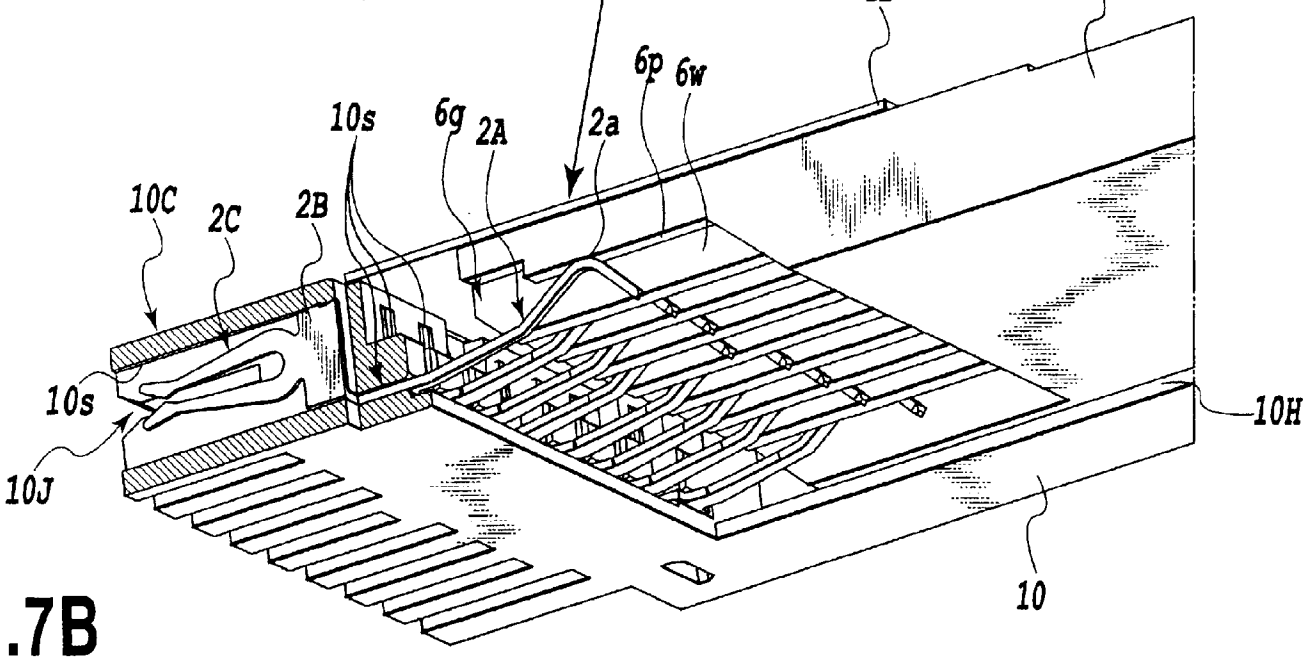
FIG. 7B is an enlarged perspective view showing a part of the housing member as shown in FIG. 7A for the card connector provided with the contact terminals according to the present invention, together with the elongate type memory card.

As shown in FIGS. 6, 7A and 7B, when the fixing section 2B is press-fit with an L-shaped groove 10*s* formed in a wall of the periphery of the accommodation portion 24 adjacent to the cable connecting section 10C, the contact terminal 2 is held by the housing member 10. The fixing section 2B of the contact terminal 2 is press-fit into the groove 10*s* in the inserting direction of the elongate type memory card 6 indicated by an arrow IN in FIG. 6.

As illustrated in FIGS. 7A, 7B, 8A and 8B in an enlarged scale, the groove 10*s* consists of a portion for holding a flat surface contiguous to the cable connecting section 2C of the contact terminal 2, and a portion for holding the card connecting section 2A. In this regard, in FIGS. 7A, 7B, 8A and 8B, a state is illustrated wherein the elongate type memory card 6 is accommodated in the accommodation portion 24. Every adjacent grooves 10*s* are partitioned by a wall.

The portion for holding the flat surface contiguous to the cable connecting section 2C of the contact terminal 2 in the respective groove 10*s* passes through the interior of the cable connecting section 10C.

As shown in FIGS. 9 and 10, the cable connecting section 10C of the housing member 10 has an insertion slot 10J for allowing the insertion of a portion of the flexible flat cable 8 in which are provided the electrode pads 8*a* while being in register. The insertion slot 10J has a width in correspondence to that of the flexible flat cable 8, and is formed corresponding to a position aligned with a gap defined between the bifurcate forks 2*ka* and 2*kb* in the clip portion 2K of the contact terminal 2 to be held.

Figure 8A:
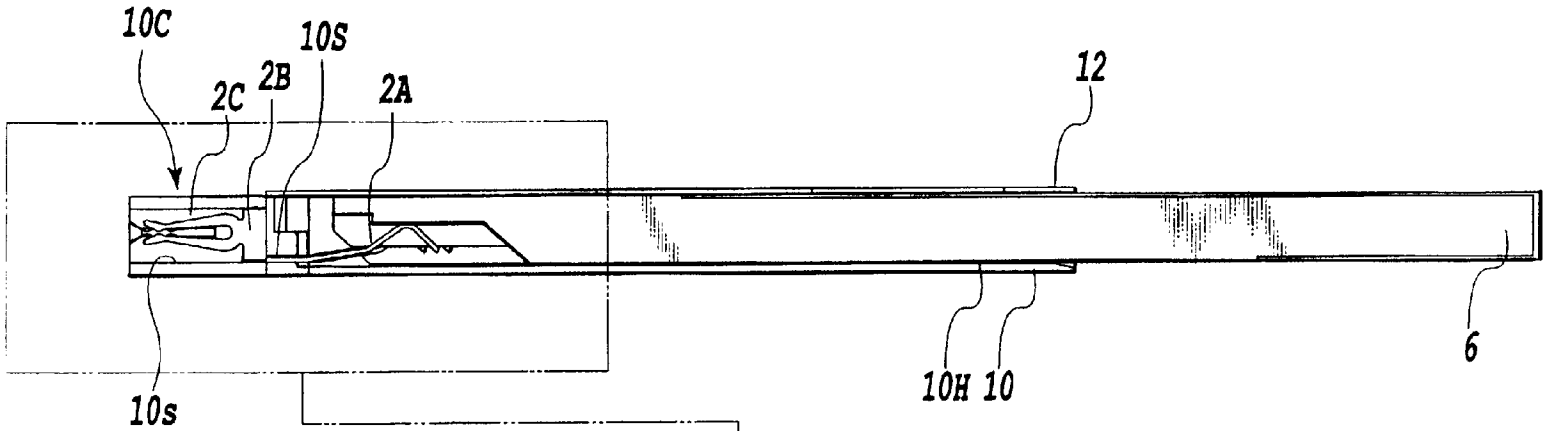
FIG. 8A is a side sectional view showing the housing member for the card connector provided with the contact terminals according to the present invention, together with the elongate type memory card.
Figure 8B:
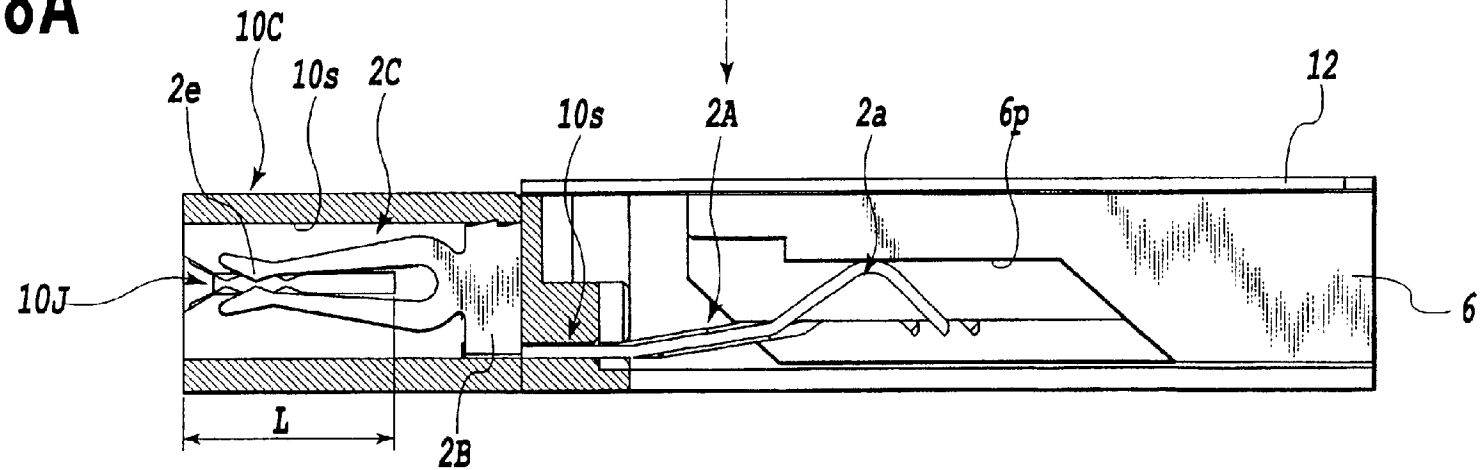
FIG. 8B is an enlarged side sectional view showing a part of the housing member as shown in FIG. 8A for the card connector provided with the contact terminals according to the present invention, together with the elongate type memory card.

In FIGS. 8A and 8B, a depth L of the insertion slot 10J is determined so that the electrode pad 8*a* is brought into contact with the contact point 2*e* when the flexible flat cable 8 is inserted until the distal end thereof touches the closed end of the insertion slot 10J.

Further, the insertion slot 10J is generally orthogonal to a part of the contact terminal 2 for holding the flat surface contiguous to the cable connecting section 2C of the contact terminal 2 in the respective groove 10*s*.

Accordingly, as shown in FIG. 9 by a chain double-dashed line, when a part of the flexible flat cable 8 in which the electrode pads 8*a* are provided is inserted into a gap between the bifurcate forks 2*ka* and 2*kb* in the clip portion 2K of the contact terminal 2 via the insertion slot 10J, the respective electrode pad 8*a* is automatically electrically connected to the contact terminal 2.

As a result, it is possible to ensure the electric connection of the respective contact terminal 2 of the card connector with the electrode pad 8*a* of the flexible flat cable 8 without the necessity of a wiring board having a conductive layer formed therein.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A contact terminal comprising:

a first connecting section for electrically connecting with an electrode pad of a cable by pinching said electrode pad between a plurality of forks in said first connecting section, said first connecting section being formed at one side of said contact terminal, and a second connecting section for electrically connecting with an electrode of a card by contacting a single side of said card, said second connecting section being formed at a second side of said contact terminal, continuous with said first connecting section.

2. A contact terminal as defined in claim 1, wherein a coupling section for coupling said first connecting section to said second connecting section is provided between said first and second connecting sections.

3. A contact terminal as defined in claim 2, wherein said coupling section has coupling surfaces orthogonal to each other and coupled to said first and second connecting sections, respectively.

4. A card connector having contact terminals, comprising:

a plurality of contact terminals, each having a first connecting section for electrically connecting with an electrode pad of a cable by pinching said electrode pad between a plurality of forks in said first connecting section, said first connecting section being formed at one side of said contact terminal and a second connecting section for electrically connecting with an electrode of a card by contacting a single side of said card, said second connecting section being formed at a second side of said contact terminal, continuous with said first connecting section, a card accommodation portion in which said second connecting sections of said contact terminals are disposed, for accommodating said card; and a cable connecting section in which said first connecting sections of said contact terminals are disposed, having an insertion slot for allowing said electrode pad of said cable to be inserted.

5. A card connector having contact terminals as defined in claim 4, wherein a coupling section for coupling said first connecting section to said second connecting section is provided between said first and second connecting sections.

6. A card connector having contact terminals as defined in claim 5, wherein said coupling section of said contact terminal is held in a groove formed in said card connector, adjacent to said card accommodation portion and said cable connecting section.

7. A card connector having contact terminals as defined in claim 6, wherein said coupling section of said contact terminal is inserted into said groove in a card inserting direction.

8. A card connector having contact terminals as defined in claim 4, wherein said card is removably accommodated in said card accommodation portion.

9. A card connector having contact terminals as defined in claim 4, wherein a plurality of contact terminals are provided in correspondence to a plurality of electrodes in said card accommodated in said card accommodation portion.

10. A card connector having contact terminals as defined in claim 4, wherein said card is an elongate type memory card.

11. A contact terminal comprising:

a first connecting section for electrically connecting with a terminal of a cable while pinching said terminal, said first connecting section being formed at a first side of said contact terminal;

a second connecting section for electrically connecting with an electrode of a card while being in contact with said electrode, said second connecting section being formed at a second side of said contact terminal; and a coupling section for coupling said first connecting section to said second connecting section, wherein:

said coupling section is provided between said first and second connecting sections; and said coupling section is configured to permit insertion of said first connection section into a groove of a card accommodation member in a same direction that the card may be inserted into said member, whereby, said coupling section may extend in said groove from a first opening in said member into which said terminal of said cable may be inserted to contact said first connecting section to a second opening in said member into which said card may be inserted to contact said second connecting section.

* * * * *